US011376492B2

(12) United States Patent
Lu

(10) Patent No.: US 11,376,492 B2
(45) Date of Patent: Jul. 5, 2022

(54) GAME TABLE

(71) Applicant: Dong Guan Song Wei Electric Technology Co., Ltd., Dongguan (CN)

(72) Inventor: Weilin Lu, Dongguan (CN)

(73) Assignee: DONG GUAN SONG WEI ELECTRIC TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/920,736

(22) Filed: Jul. 5, 2020

(65) Prior Publication Data

US 2022/0001270 A1 Jan. 6, 2022

(51) Int. Cl.
*A63F 11/00* (2006.01)
*A63F 7/06* (2006.01)

(52) U.S. Cl.
CPC ..... *A63F 11/0051* (2013.01); *A63F 7/0616* (2013.01); *A63F 7/0632* (2013.01); *A63F 7/0672* (2013.01); *A63F 2011/0069* (2013.01)

(58) Field of Classification Search
CPC .. A63F 11/0051; A63F 7/0616; A63F 7/0632; A63F 7/0672; A63F 2011/0069
USPC ..... 434/168, 203
See application file for complete search history.

(56) References Cited

U.S. PATENT DOCUMENTS 2,961,796 A * 11/1960 Davis ..... A63H 33/22 446/241
3,747,934 A * 7/1973 Barrett ..... A63F 9/0402 273/268
5,377,998 A * 1/1995 Schainbaum ..... A63F 9/06 273/459
5,884,911 A * 3/1999 Guridi ..... A63F 7/0672 273/119 R
D588,271 S * 3/2009 Schendel ..... D8/387
2008/0197564 A1* 8/2008 Tsai ..... A63F 7/0672 273/108.52
2010/0201067 A1* 8/2010 Liao ..... A63F 7/06 273/108.1
2010/0308534 A1* 12/2010 Lu ..... A63F 7/0672 273/108.1

OTHER PUBLICATIONS

Sundance, Classic Foosball Table, https://web.archive.org/web/20170531084348/http://www.sundancecatalog.com:80/product/classic+foosball+table.do (Year: 2017).*

* cited by examiner

*Primary Examiner* — Michael D Dennis
(74) *Attorney, Agent, or Firm* — Leong C. Lei

(57) ABSTRACT

A game table includes a table body and a score counter mounted to the table body. The score counter includes a middle rod and a plurality of scoring beads. The scoring beads are movably sleeved on the middle rod. Two ends of the middle rod are provided with fixing rods, respectively. The two ends of the middle rod are inserted into fixing holes of the fixing rods to be positioned therein. The score counter has an ingenious design and can be installed conveniently. The installation and positioning accuracy is good. After a period of use, the middle rod of the score counter is still in the axis position, and the reliability of use is good.

6 Claims, 12 Drawing Sheets

GAME TABLE

BACKGROUND OF THE INVENTION

1. Field of the Invention

The present invention relates to game appliances, and more particularly to a game table.

2. Description of the Prior Art

A bead-type score counter is generally composed of a rod body and scoring beads that can be movably arranged on the rod body. It has a simple structure, so it is widely used in game tables such as table football tables or air hockey tables. The score counter is configured to record the score.

When the conventional bead-type score counters are installed and applied to the game tables, some structures are simple and the installation is convenient. However, in terms of installation positioning accuracy, especially after a period of use, the position of the rod body is prone to deviation, which will affect the use. Some designs have better installation and positioning accuracy, but the installation is not easy.

In addition, in the conventional bead-type score counter, because the scoring beads are made of metal or hard plastic material, it is easy to scratch the rod body when moving the scoring beads, so the scoring beads and the rod body may have scratches. As a result, the scoring beads cannot be moved smoothly to affect the use. After a period of use, the scoring beads may jam on the rod body to cause damages.

SUMMARY OF THE INVENTION

In view of the shortcomings of the prior art, the primary object of the present invention is to provide a game table with a score counter that has an ingenious design and can be installed conveniently. The installation and positioning accuracy is good. After a period of use, a rod of the score counter is still in the axis position, and the reliability of use is good.

In order to achieve the above object, the present invention adopts the following technical solutions:

A game table comprises a table body and a score counter mounted to the table body.

The table body includes a table top, a support under the table top, and a side frame surrounding the table top. The side frame includes a pair of side plates and a pair of end plates to be connected together.

The score counter includes a middle rod and a plurality of scoring beads. The scoring beads are movably sleeved on the middle rod. Two ends of the middle rod are provided with fixing rods, respectively. The fixing rods have fixing holes therein. The two ends of the middle rod are inserted into the corresponding fixing holes and positioned to the fixing rods, respectively.

Compared with the prior art, the present invention has obvious advantages and beneficial effects. Specifically, it can be known from the above technical solutions. The score counter has an ingenious design and can be installed conveniently. The installation and positioning accuracy is good. After a period of use, the middle rod of the score counter is still in the axis position, and the reliability of use is good.

Embodiments of the present invention will now be described, by way of example only, with reference to the accompanying drawings.

DETAILED DESCRIPTION OF THE PREFERRED EMBODIMENTS

Figure 1:
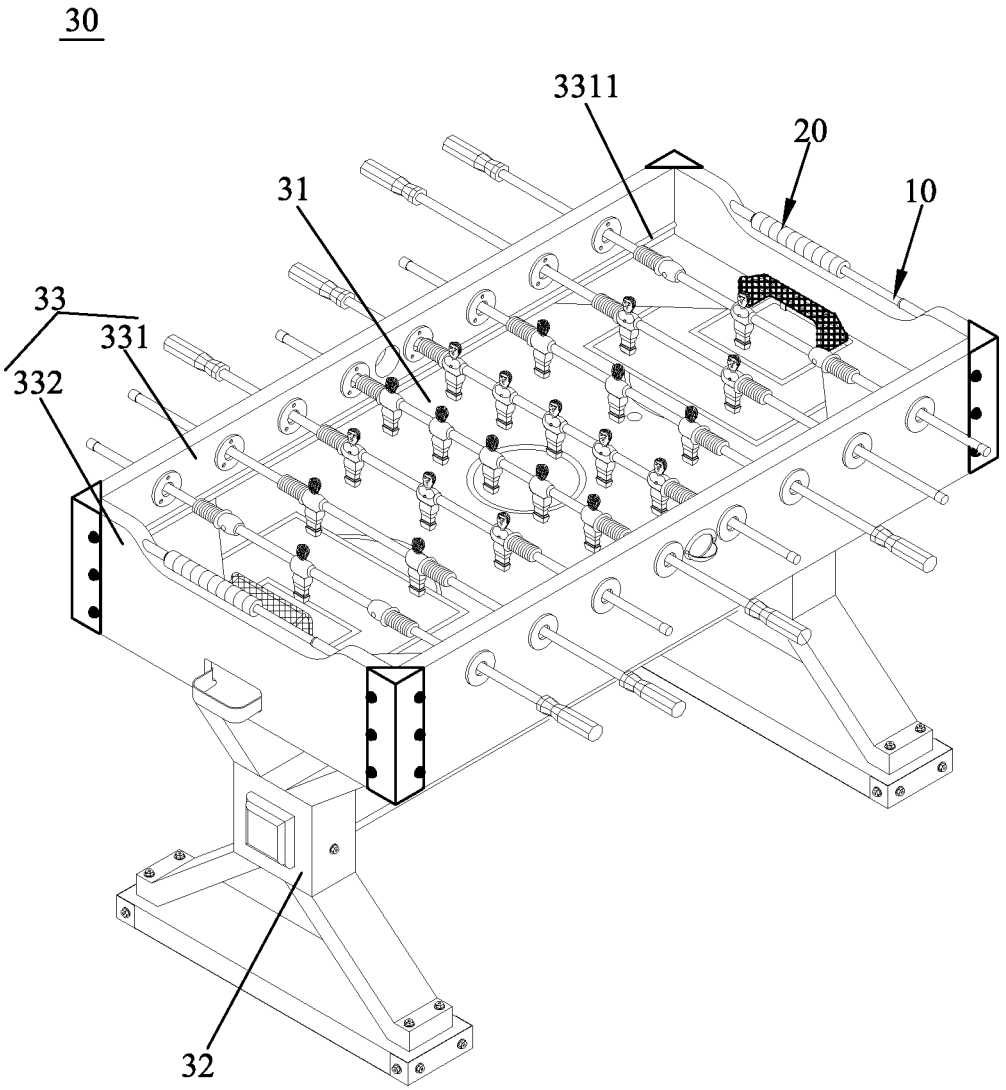
FIG. 1 is a perspective view according to a first embodiment of the present invention (the game table is a table football table)
Figure 2:
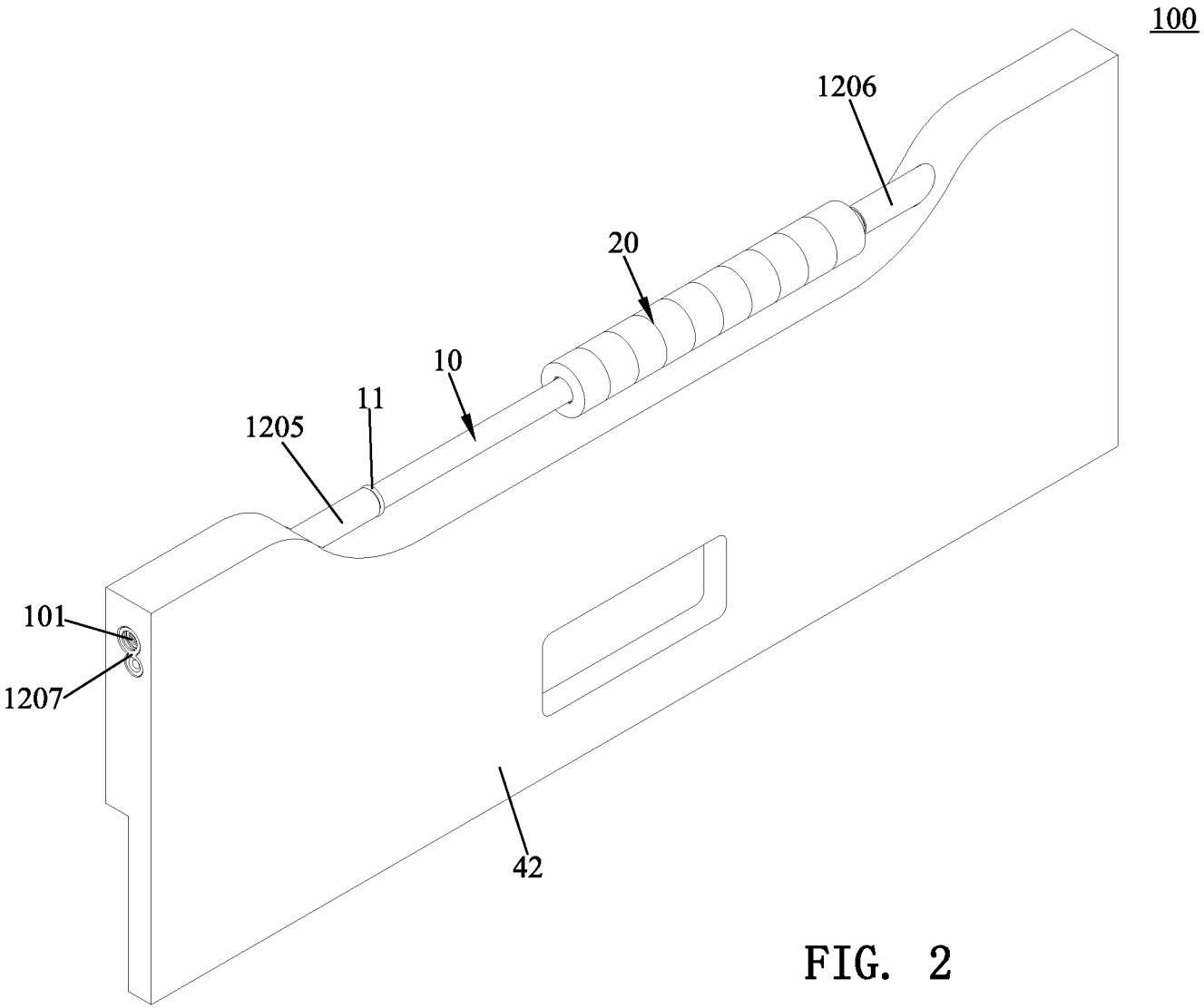
FIG. 2 is a partial schematic view according to the first embodiment of the present invention.
Figure 3:
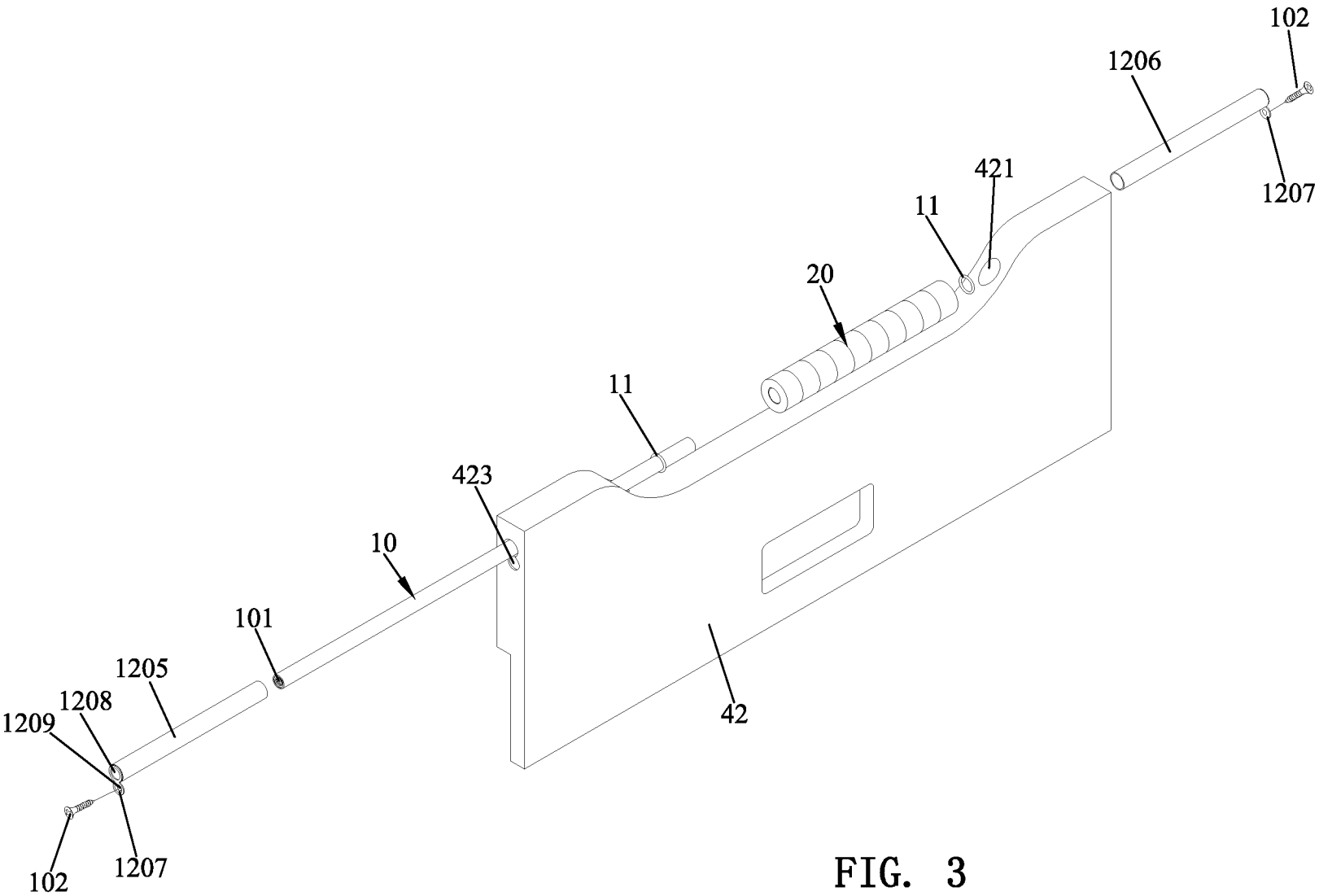
FIG. 3 is an exploded view of FIG. 2.
Figure 4:
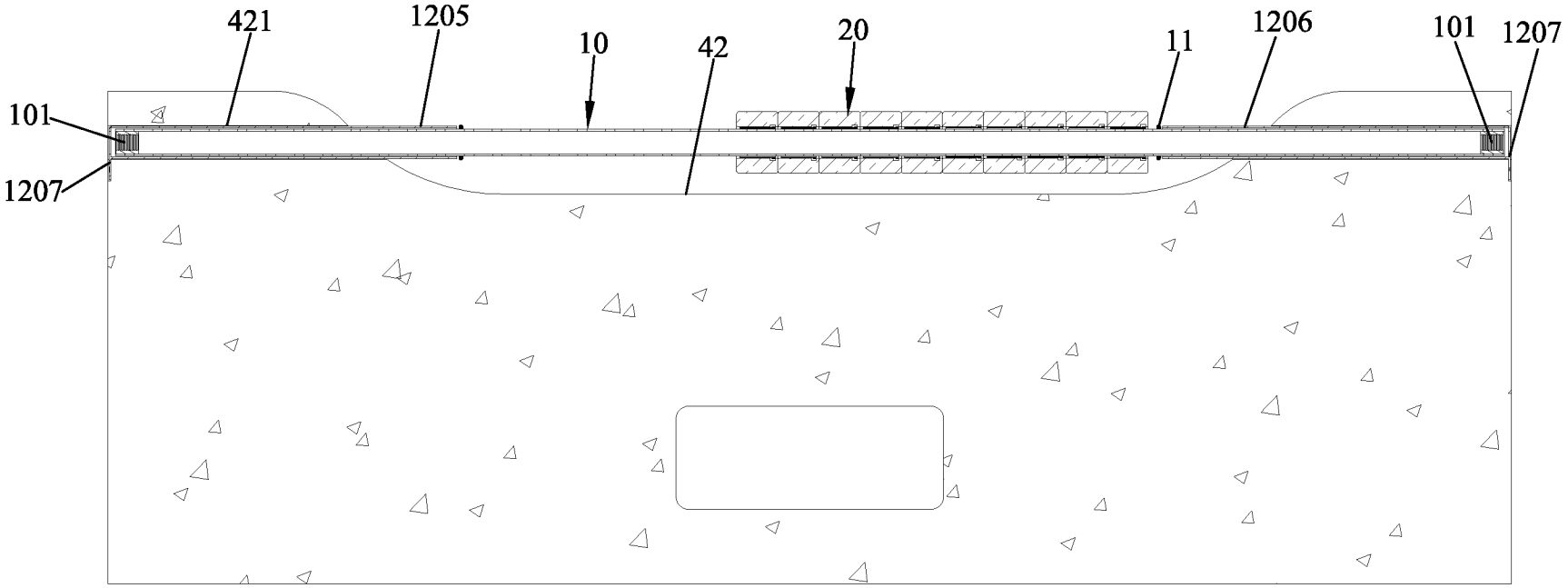
FIG. 4 is a partial cross-sectional view according to the first embodiment of the present invention.
Figure 5:
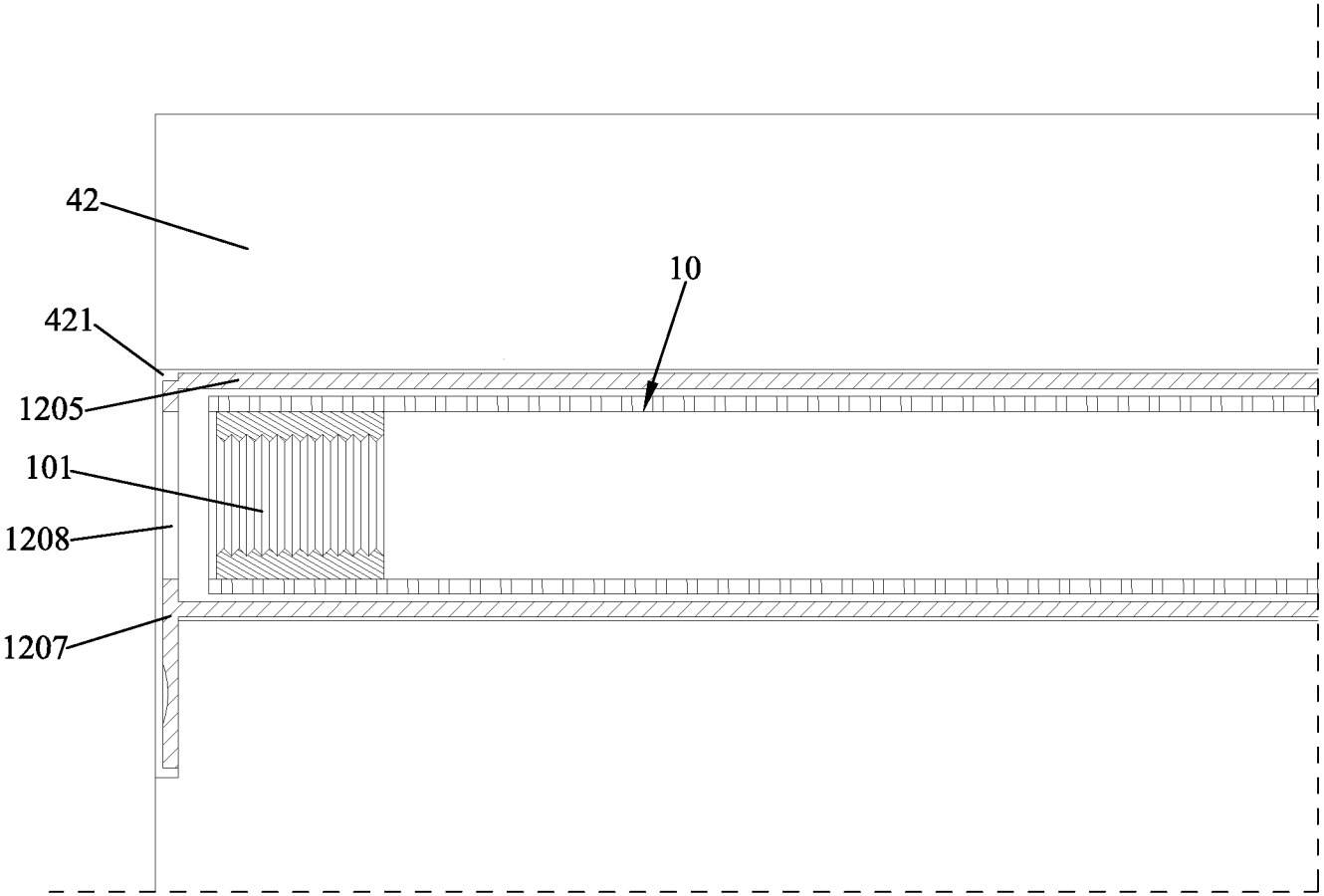
FIG. 5 is a partial enlarged view of FIG. 4.
Figure 6:
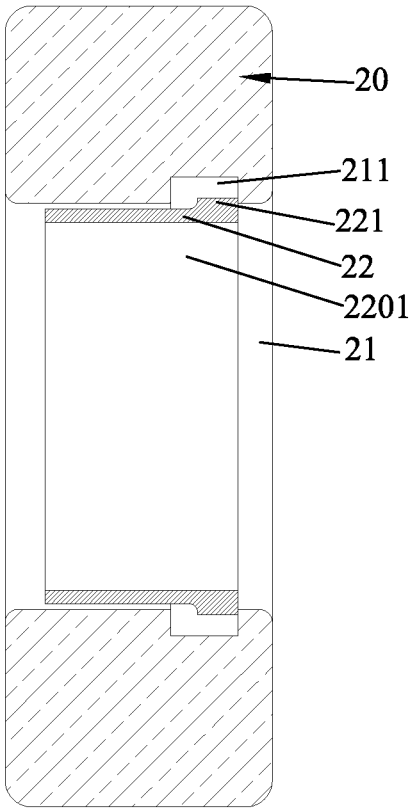
FIG. 6 is a cross-sectional view of the scoring bead according to the first embodiment of the present invention.
Figure 7:
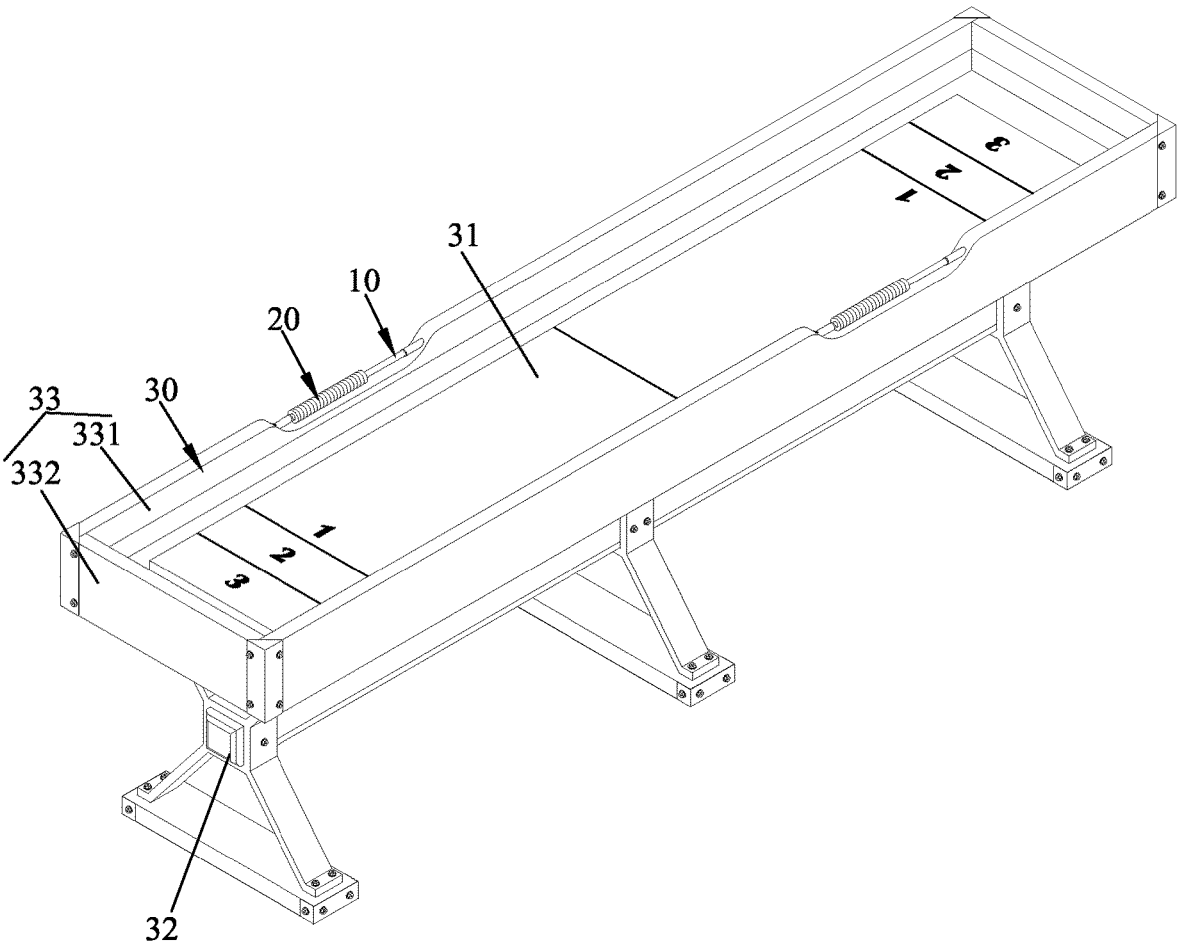
FIG. 7 is a perspective view according to a second embodiment of the present invention (the game table is an air hockey table)
Figure 8:
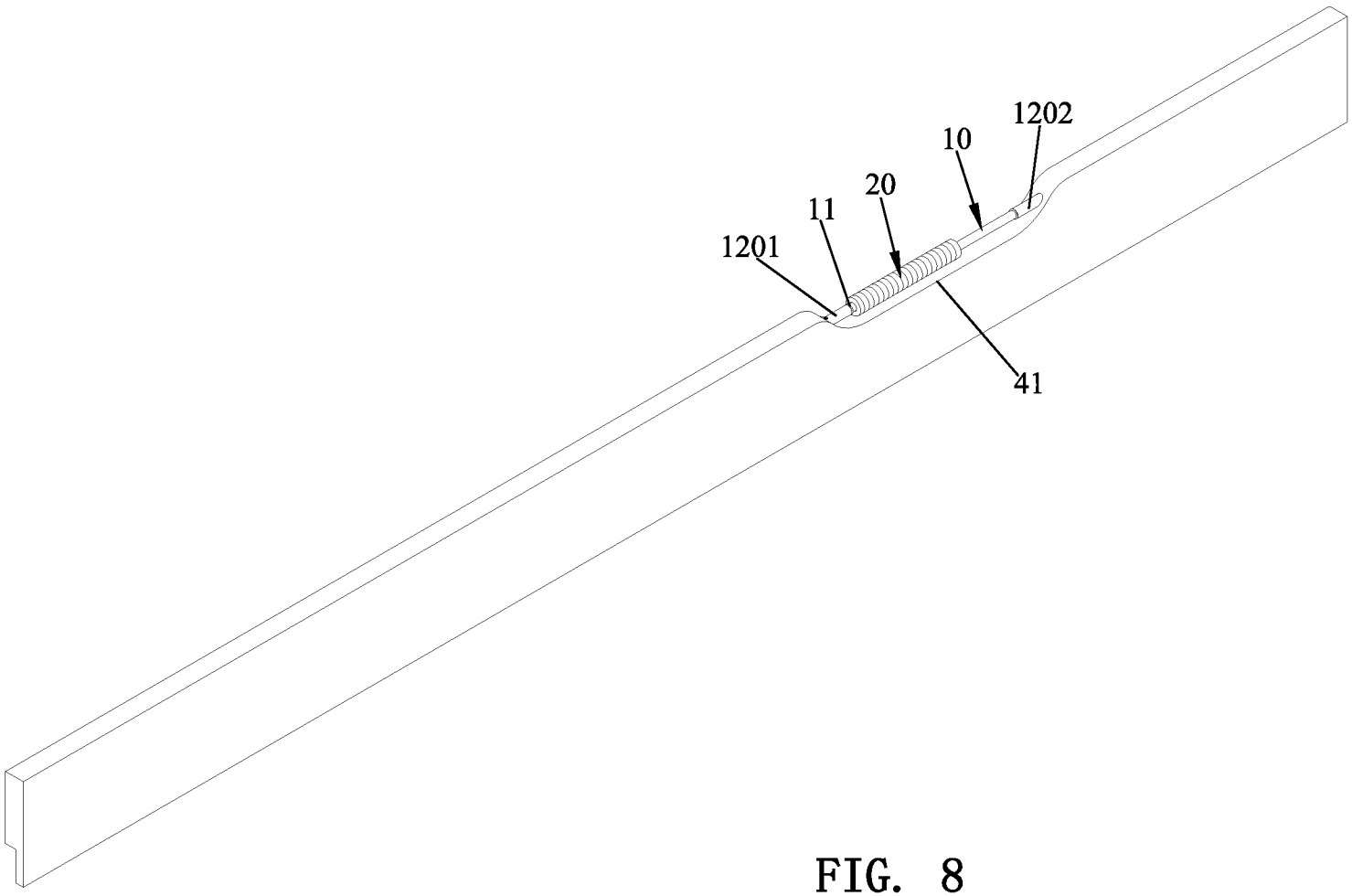
FIG. 8 is a partial schematic view according to the second embodiment of the present invention.
Figure 9:
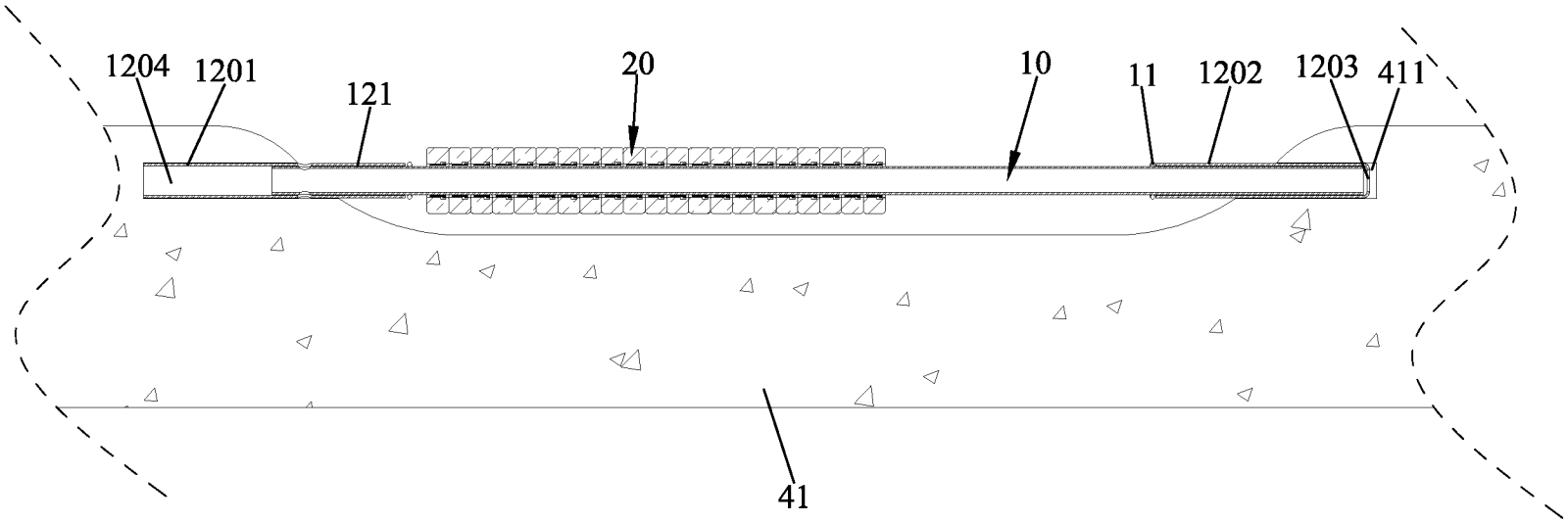
FIG. 9 is a partial cross-sectional view of FIG. 8.
Figure 10:
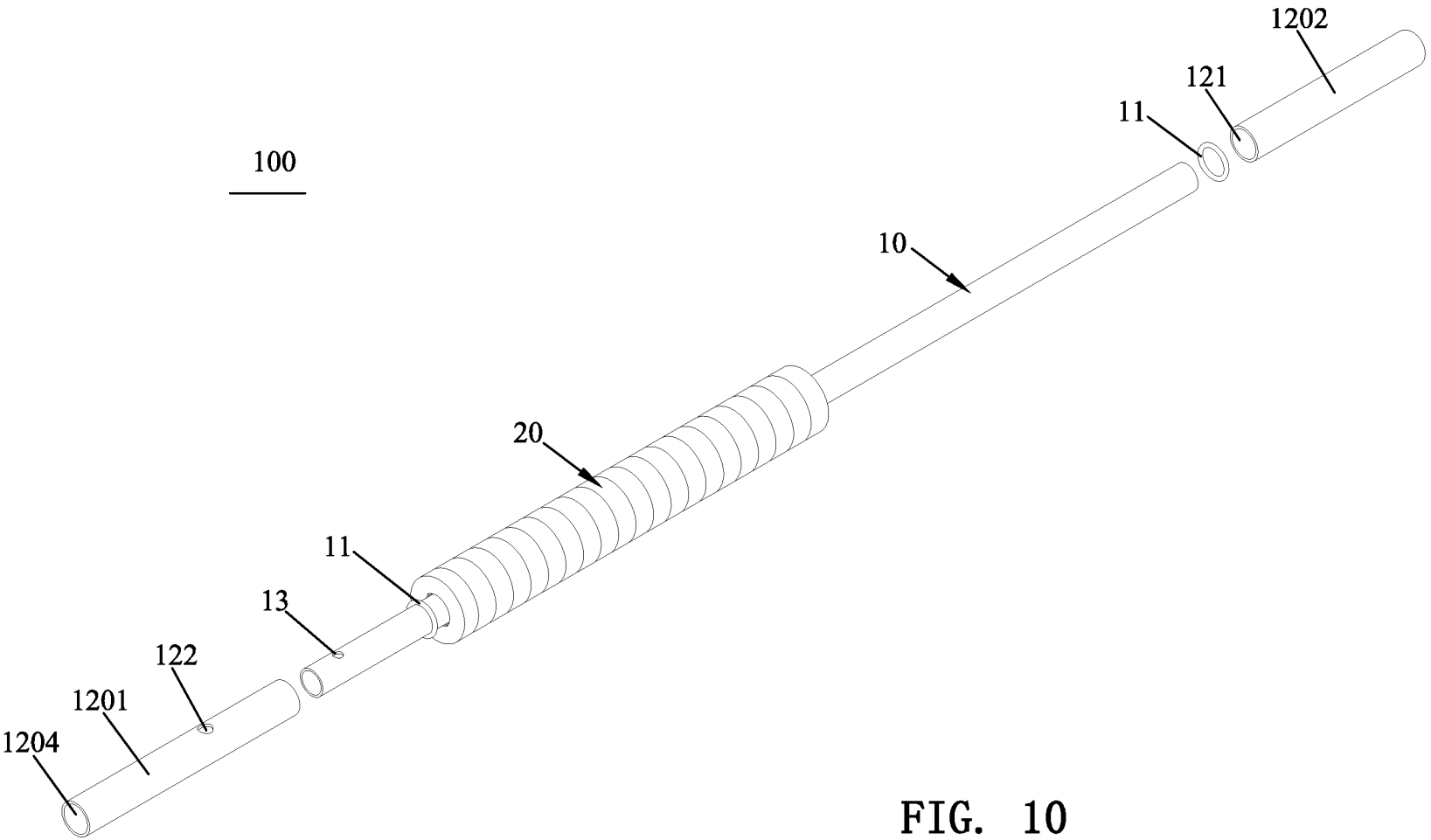
FIG. 10 is a perspective view of the scoring bead according to the second embodiment of the present invention.
Figure 11:
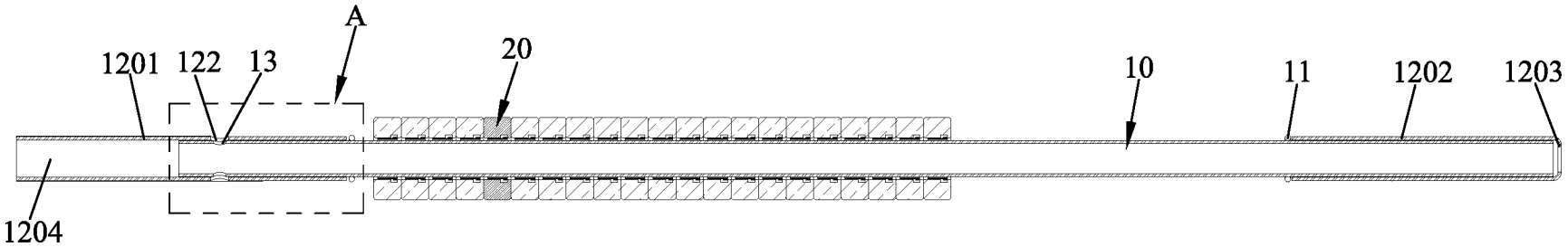
FIG. 11 is a cross-sectional view of the scoring bead according to the second embodiment of the present invention.
Figure 12:
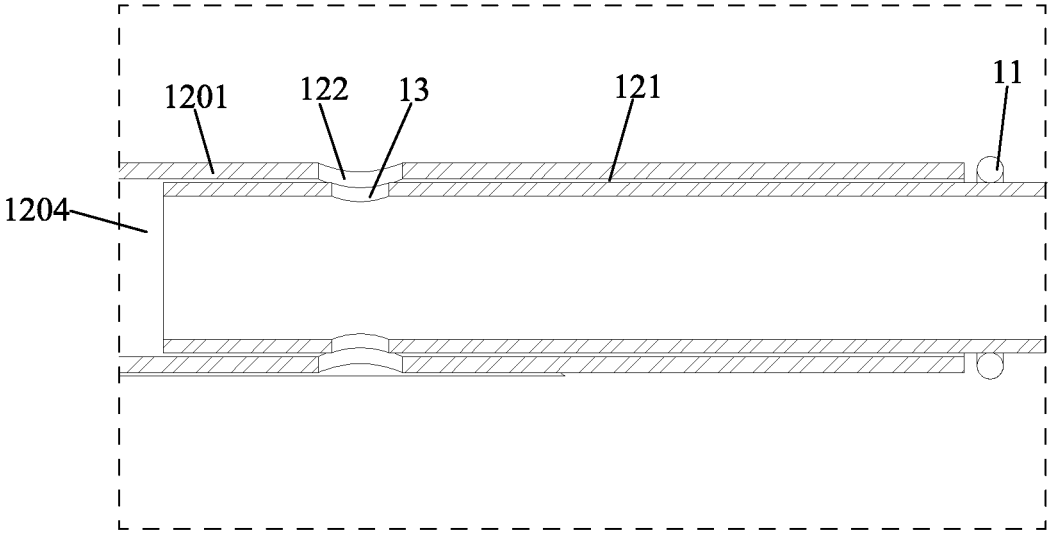
FIG. 12 is a partial enlarged view of circle A of FIG. 11.

FIGS. 1 to 12 show the specific structures of various embodiments of the present invention. The present invention discloses a game table, comprising a table body 30 and a score counter 100.

As shown in FIGS. 1 to 6, the table body 30 includes a table top 31, a support 32 under the table top 31, and a side frame 33 surrounding the table top 31. The side frame 33 includes a pair of side plates 331 and a pair of end plates 332 to be connected together. The game table is a table football table. The inner walls of the two side plates 331 are provided with elastic rubber strips 3311 for the elastic impact of a toy football. The elastic rubber strips 3311 are disposed at the lower edges of the inner walls of the pair of side plates 331. Through the elastic rubber strips 3311, the toy football can roll to the area where the figures can kick under the elastic effect when the toy football hit the elastic rubber strips in the game. In this way, the game table can reduce the occurrence of dead balls, improve the continuity in the game, and enhance the fun and entertainment of the game. Preferably, the elastic rubber strips 3311 protrude from the inner walls of the side plates 311.

The score counter 100 includes a middle rod 10 and a plurality of scoring beads 20. Two ends of the middle rod 10 are provided with anti-collision protective rings 11. The scoring beads 20 are movably sleeved on the middle rod 10 and located between the anti-collision protective rings 11. The two ends of the middle rod 10 are provided with fixing rods, respectively. Each anti-collision protective ring 11 is sleeved on the outer periphery of the middle rod 10 and abuts against one end of a corresponding one of the fixing rods. Through the anti-collision protective rings 11 disposed on both ends of the middle rod, after the middle rod is installed on the table body 30, the anti-collision protective rings are configured to avoid collision with the table body 30 when the scoring beads are moved. Through the anti-collision protective rings 11 to reduce the collision force generated by the scoring beads 20, the collision force generated by the scoring beads against the table body will not cause the middle rod to loosen in the use of the score counter, and the middle rod can be firmly installed on the table body 30 to prolong the service life of the score counter 100.

Each fixing rod is formed with a fixing hole 121. The two ends of the middle rod 10 are inserted into the corresponding fixing holes 121 of the fixing rods, respectively. The fixing rods are defined as a third fixing rod 1205 and a fourth fixing rod 1206, respectively. A second mounting seat 42 for mounting the fixing rods is provided. The second mounting seat 42 is formed with two second mounting holes 421 which are spaced a distance along the axial direction of the middle rod 10 and are aligned with each other and extends through two outer ends of the second mounting seat 42. The third fixing rod 1205 and the fourth fixing rod 1206 are located in the corresponding second mounting holes 421, respectively. The two ends of the middle rod 10 are located in the third fixing rod 1205 and the fourth fixing rod 1206, respectively. The two ends of the middle rod 10 and the outer ends of the third fixing rod 1205 and the fourth fixing rod 1206 are connected and positioned at the two outer ends of the second mounting seat 42, respectively. The second mounting seat 42 may be installed to the end plate 332, or the second mounting seat 42 may directly serve as the end plate 332.

The outer ends of the third fixing rod 1205 and the fourth fixing rod 1206 are connected with mounting plates 1207. Each mounting plate 1207 is formed with a first locking hole 1208 and a second locking hole 1209. The first locking holes 1208 of the mounting plates 1207 correspond to the outer ends of the third fixing rod 1205 and the fourth fixing rod 1206, respectively. The two ends of the middle rod 10 are provided with internal threaded connection portions 101. The outer ends of the second mounting seat 42 are formed with third locking holes 423 corresponding to the second locking holes 1209 of the mounting plates 1207. The third fixing rod 1205 and the fourth fixing rod 1206 are inserted into the second mounting holes 421 from the two outer ends of the second mounting seat 42. The first locking holes of the mounting plates are arranged corresponding to the corresponding internal threaded connection portions 101. The second locking holes of the mounting plates and the third locking holes are connected and positioned by first screws 102.

Each scoring bead 20 is formed with a through hole 21. A protective sleeve 22 is installed in the through hole 21. The scoring bead 20 is in clearance fit with the outer periphery of the middle rod 10 through an inner hole 2201 of the protective sleeve 22. The through hole 21 is provided with an engaging recess 211, and the protective sleeve 22 is provided with an engaging protrusion 221. The protective sleeve 22 is inserted from one end of the through hole 21, and the engaging protrusion 221 is engaged in the engaging recess 211. By the engagement of the engaging protrusion 221 and the engaging recess 211, the installation of the scoring bead 20 and the protective sleeve 22 is simpler and more convenient. The scoring bead is preferably made of a hard plastic or metal material, and the protective sleeve 22 and the anti-collision protective rings are preferably made of a rubber material.

As shown in FIGS. 7 to 10, the game table is an air hockey table.

The fixing rods are defined as a first fixing rod 1201 and a second fixing rod 1202, respectively. The outer end of the second fixing rod 1202 is provided with a stop portion 1203. One end of the middle rod 10 is inserted into the fixing hole 121 of the second fixing rod 1202. The end of the middle rod 10 is restricted by the stop portion 1203. The other end of the middle rod 10 is formed with a first connection hole 13 perpendicular to the axial direction of the middle rod 10. The first fixing rod 1201 is formed with a second connection hole 122 corresponding to the first connection hole 13.

The other end of the middle rod 10 is inserted into the fixing hole 121 of the first fixing rod 1201. A perforation section 1204 is formed between the outer end of the first fixing rod 1201 and the second connecting hole 122. The other end of the middle rod 10 is inserted into the perforation section 1204, enabling the outer end of the second fixing rod 1202 to move toward the first fixing rod 1201 along with the middle rod to shorten the overall length of the middle rod. In this way, the overall length of the middle rod can be adjusted as desired, so that the score counter can be installed in a variety of installation positions with different specifications, and the adaptability is good.

A first mounting seat 41 for mounting the first fixing rod 1201 and the second fixing rod 1202 is provided. The first mounting seat 41 is formed with two first mounting holes 411 which are spaced a distance along the axial direction of the middle rod 10 and are aligned with each other. In a shortened state, one end of the middle rod is inserted into one of the first mounting holes 411, and the other end of the middle rod 10 slides in a reverse direction with respect to the perforation section 1204 to be inserted into the other first installation hole 411. The first connection hole 13 and the second connection hole 122 are connected and positioned. The first mounting seat 41 may be installed to the side plate 331, or the first mounting seat 41 may directly serve as the side plate 331.

What is claimed is:

1. A game table, comprising a table body and a score counter mounted to the tale body; the table body including a table top, a support under the table top, and a side frame surrounding the table top, the side frame including a pair of side plates and a pair of end plates to he connected together; the score counter including, a middle rod and a plurality of scoring beads, the scoring beads being movably sleeved on the middle rod; two ends of the middle rod being provided with fixing rods respectively, the fixing rods having fixing holes therein, the two ends of the middle rod being inserted into the corresponding fixing holes and positioned to the fixing rods, respectively; wherein the fixing rods are defined as a third fixing rod and a fourth fixing rod, respectively; and a second mounting seat for mounting the fixing rods, wherein the second mounting seat is mounted to each end plate or the second mounting seat directly serves as each end plate, the second mounting seat is formed with two second mounting holes which are spaced a distance along an axial direction of the middle rod and are aligned with each other and extends through two outer ends of the second mounting seat, the third fixing rod and the fourth fixing rod are located in the corresponding second mounting holes respectively, the two ends of the middle rod are located in the third fixing rod and the fourth fixing rod respectively, the two ends of the middle rod and outer ends of the third fixing rod and the fourth fixing rod are connected and positioned at the two outer ends of the second mounting seat, respectively; the outer ends of the third fixing rod and the fourth fixing rod are connected with mounting plates, each mounting plate is formed with a first locking hole and a second locking hole, the first locking holes of the mounting plates correspond to the outer ends of the third fixing rod and the fourth fixing rod respectively, the two ends of the middle rod are provided with internal threaded connection portions; the outer ends of the second mounting seat are formed with third locking holes corresponding to the second locking holes of the mounting plates, the third fixing rod and the fourth fixing rod are inserted into the second mounting holes from the two outer ends of the second mounting seat respectively, the first locking holes of the mounting plates are arranged corresponding to the internal threaded connection portions, and the second lock ng holes of the mounting plates and the third locking holes are connected and positioned by first screws.

2. The game table as claimed in claim 1, wherein the game table is a table football table; inner walls of the pair of side plates are provided with elastic rubber strips.

3. The game table as claimed in claim 2, wherein the elastic rubber strips protrude from the inner walls of the side plates.

4. The game table as claimed in claim 1, wherein the two ends of the middle rod are provided with anti-collision protective rings, each anti-collision protective ring is sleeved on an outer periphery of the middle rod and abuts against one end of a corresponding one of the fixing rods; the scoring beads are movably sleeved on the middle rod and located between the anti-collision protective rings.

5. The game table as claimed in claim 1, wherein each scoring bead is formed with a through hole, a protective sleeve is installed in the through hole, and each scoring bead is in clearance fit with an outer periphery of the middle rod through an inner hole of the protective sleeve.

6. The game table as claimed in claim 5, wherein the through hole is provided with an engaging recess, the protective sleeve is provided with an engaging protrusion; the protective sleeve is inserted from one end of the through hole, and the engaging protrusion is engaged in the engaging recess.

* * * * *